United States Patent [19]

Castro

[11] Patent Number: 4,712,261

[45] Date of Patent: Dec. 15, 1987

[54] MATTRESS GUARD

[75] Inventor: Bernard Castro, Ocala, Fla.

[73] Assignee: Castro Convertible Corporation

[21] Appl. No.: 45,250

[22] Filed: Apr. 27, 1987

Related U.S. Application Data

[63] Continuation of Ser. No. 714,164, Mar. 20, 1985, abandoned.

[51] Int. Cl.[4] ..... A47C 31/00

[52] U.S. Cl. ..... 5/499; 5/501; 5/455; 24/72.5

[58] Field of Search ..... 5/455, 495–499, 5/501; 24/72.5

[56] References Cited

U.S. PATENT DOCUMENTS

| | | | |
|---|---|---|---|
| 438,639 | 10/1890 | Rapelye | 24/72.5 |
| 940,967 | 11/1909 | Hastings | 5/498 X |
| 1,562,809 | 11/1925 | Thompson | 5/499 X |
| 1,772,429 | 7/1929 | Kaufman | 5/499 |
| 1,892,841 | 1/1933 | Kaufmann | 24/72.5 |
| 1,963,739 | 6/1934 | Engel | 5/499 |
| 2,450,923 | 10/1948 | Spiro, Jr. | 5/499 |
| 2,700,778 | 2/1955 | Syracuse | 5/496 |
| 3,011,182 | 12/1961 | Burks | 5/484 |
| 3,134,110 | 5/1964 | Barcat | 5/498 |
| 3,191,198 | 6/1962 | Castro | 5/501 |
| 4,336,621 | 6/1982 | Schwartz et al. | 5/446 |
| 4,442,556 | 4/1984 | Craige | 5/13 |

FOREIGN PATENT DOCUMENTS

| | | | |
|---|---|---|---|
| 722596 | 1/1955 | United Kingdom | 5/496 |

*Primary Examiner*—John E. Murtagh
*Assistant Examiner*—Andrew Joseph Rudy
*Attorney, Agent, or Firm*—Pasquale A. Razzano

[57] ABSTRACT

A mattress guard is disclosed for use in a convertible sofa bed having an air inflatable mattress supported on the mattress support of a folding bed mechanism frame. The mattress guard includes a pair of flexible guard members adapted to be placed on opposed edges of the mattress, elastic straps resiliently securing the guard members together along the top surface of the mattress and attachment devices for securing the guard members to the mattress support below the mattress. The guard members hold the bedding for the mattress securely against the mattress and prevent it from becoming entrapped in the folding mechanism when the bed is folded. In addition the mattress, will be compressed when air is released therefrom prior to folding of the sofa bed to space its edges away from the mechanism.

6 Claims, 6 Drawing Figures

10
12
14
16
18
20
22
24
26
28
30
32
34
36
38
40
42
44
50
52
54
56
60
64
66
68
70

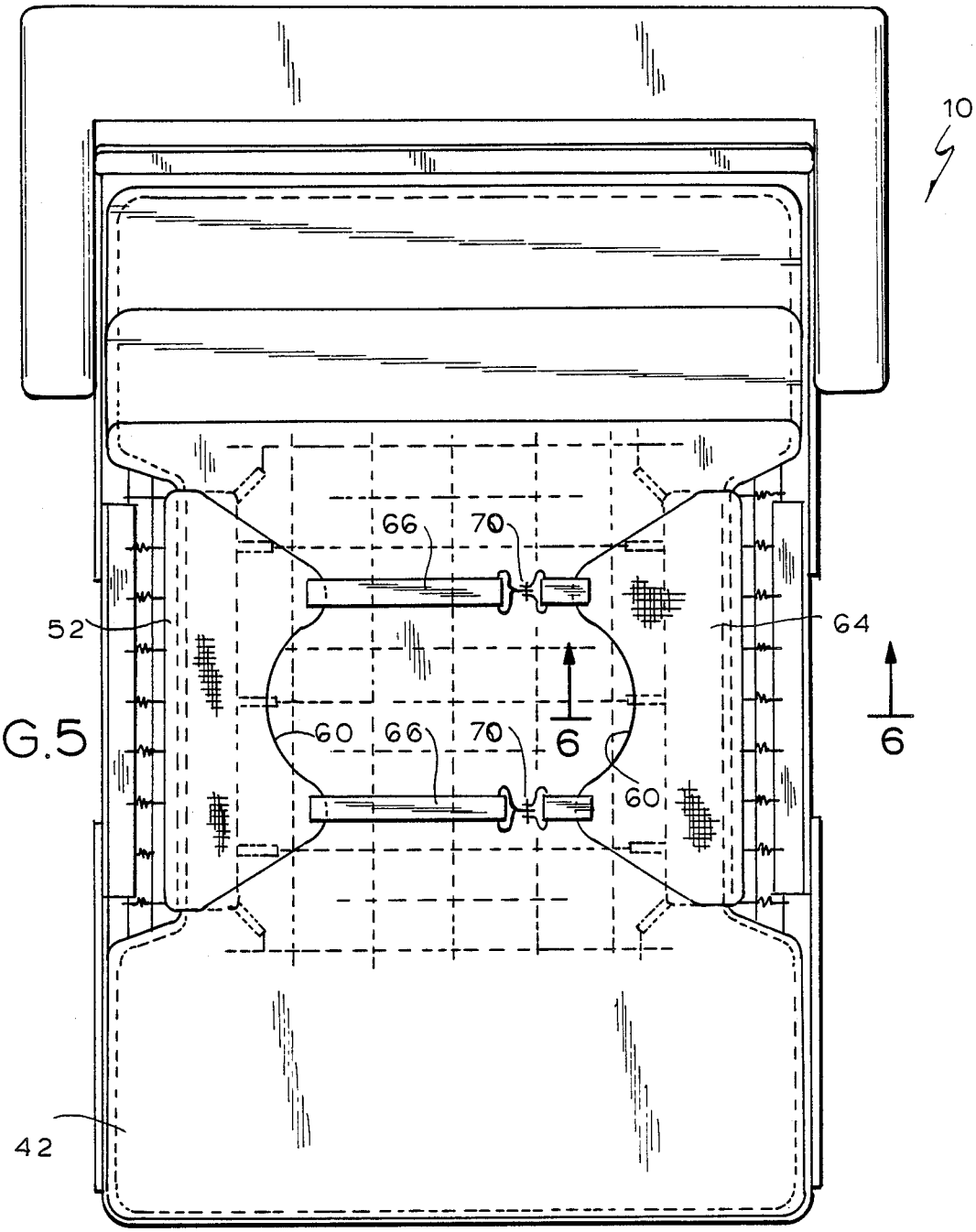
FIG.5
FIG. 6
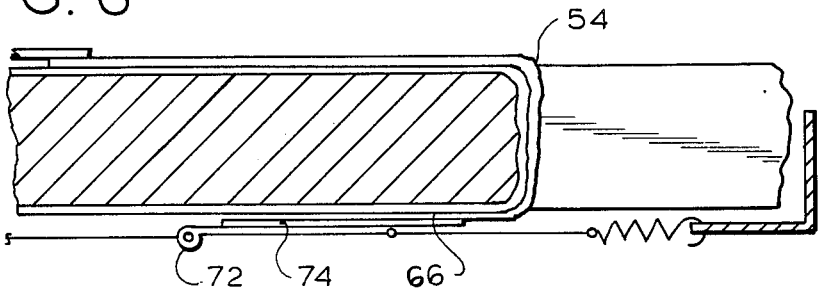

MATTRESS GUARD

This application is a continuation of application Ser. No. 714,164 filed Mar. 20, 1985, now abandoned.

The present invention relates to convertible sofas, and more particularly to a mattress guard adapted for use with a convertible sofa bed mechanisms.

Convertible sofa bed mechanisms typically include a linkage mechanism along a mattress support frame with the mechanism consisting of a plurality of variably moveable links. One problem with convertible sofa bed mechanisms is that if the bedding (namely sheets and blankets), is left on the mattress, it can become entangled or caught in the linkage mechanism when the mechanism is folded. This causes possible damage to the bedding material, and jamming of the mechanism.

It is an object of the present invention to provide a mattress guard which will protect the bedding on the mattress from the sofa bed linkage mechanism when the mechanism is folded.

Another object of the invention is to provide a mattress guard which will serve to compress an inflatable mattress when it is used in a sofa bed mechanism.

A further object of the present invention is to provide a mattress guard which is relatively simple in construction and durable in use.

In accordance with an aspect of the present invention a mattress guard for use in a convertible sofa bed is provided. The mattress guard is used on the mattress of the sofa bed which is supported in a known manner on a foldable frame that includes an underlying mattress support. The mattress guard consists of a pair of flexible mattress edge guard sheet members located along opposed longitudinal sides of the mattress, adjacent the folding linkage mechanism for the sofa bed. Each of the guard sheets has first and second opposed edges with elastic straps resiliently securing the first edges of each sheet together on the top side of the mattress. The second edges of the mattress guards are connected to the mattress support below the mattress. The elastic straps have releasable connections to permit the first edges of the mattress guards to be separated from one another when the bed is in use. These straps are reconnected prior to folding of the sofa bed so that the guards on each side of the bed hold the bedding, namely the sheets and blankets, against the mattress out of the way of the linkage mechanism for the sofa bed.

The above, and other objects, features and advantages of this invention will be apparent in the following detailed description of an illustrative embodiment thereof, which is to be read in connection with the accompanying drawings wherein:

FIG. 5 is a plan view similar to FIG. 3, but showing the configuration of the mattress guard arrangement when used with an air mattress that is partially deflated prior to folding of the mechanism;

FIG. 6 is a partial sectional view taken along line 6—6 of FIG. 5.

Figures 1, 2:
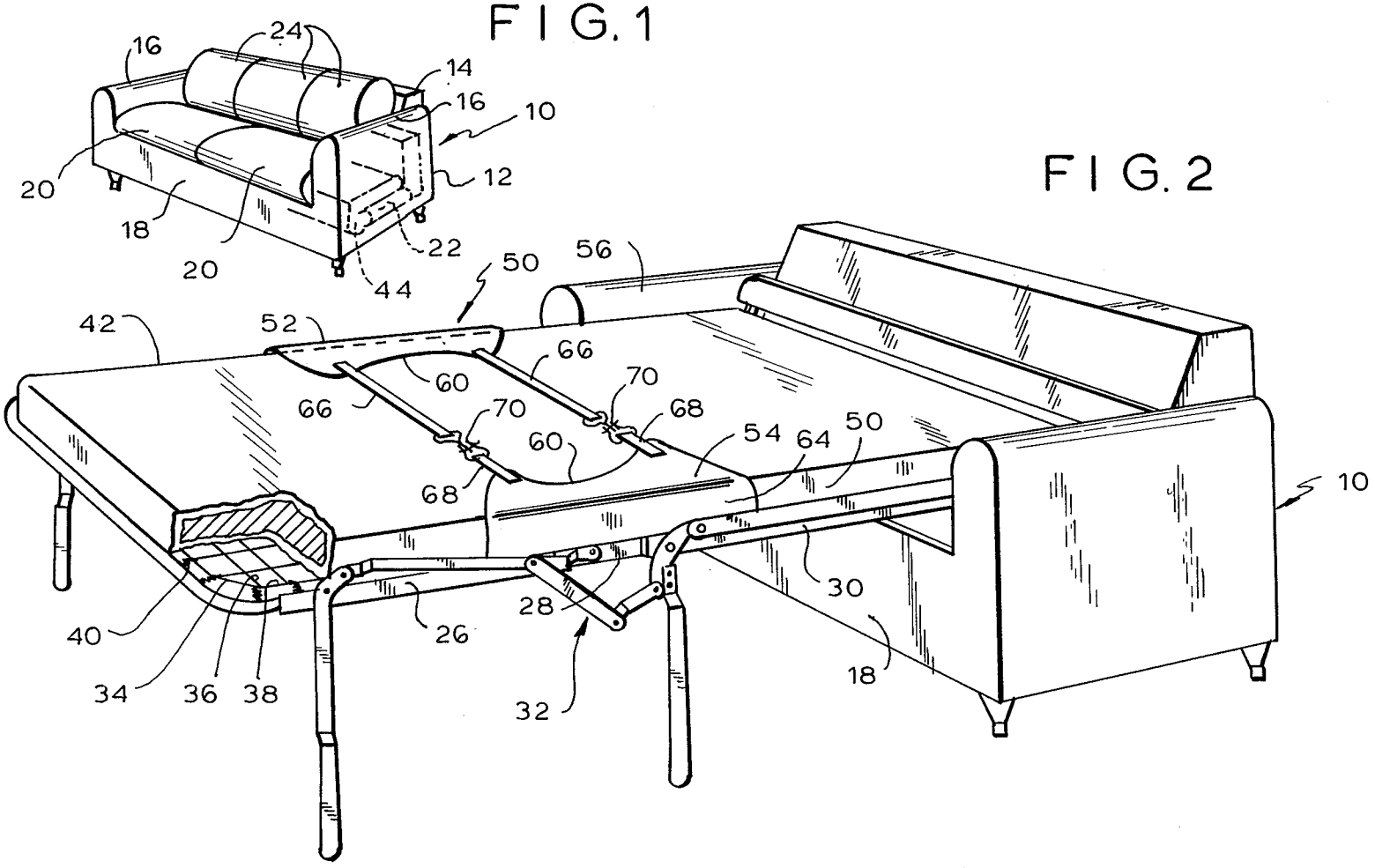
FIG. 1 is a perspective view of a sofa bed of conventional construction in which the mattress guard of the present invention is used.
FIG. 2 is a perspective view showing the sofa bed mechanism in its unfolded position, with the mattress guard in place.
Figure 3:
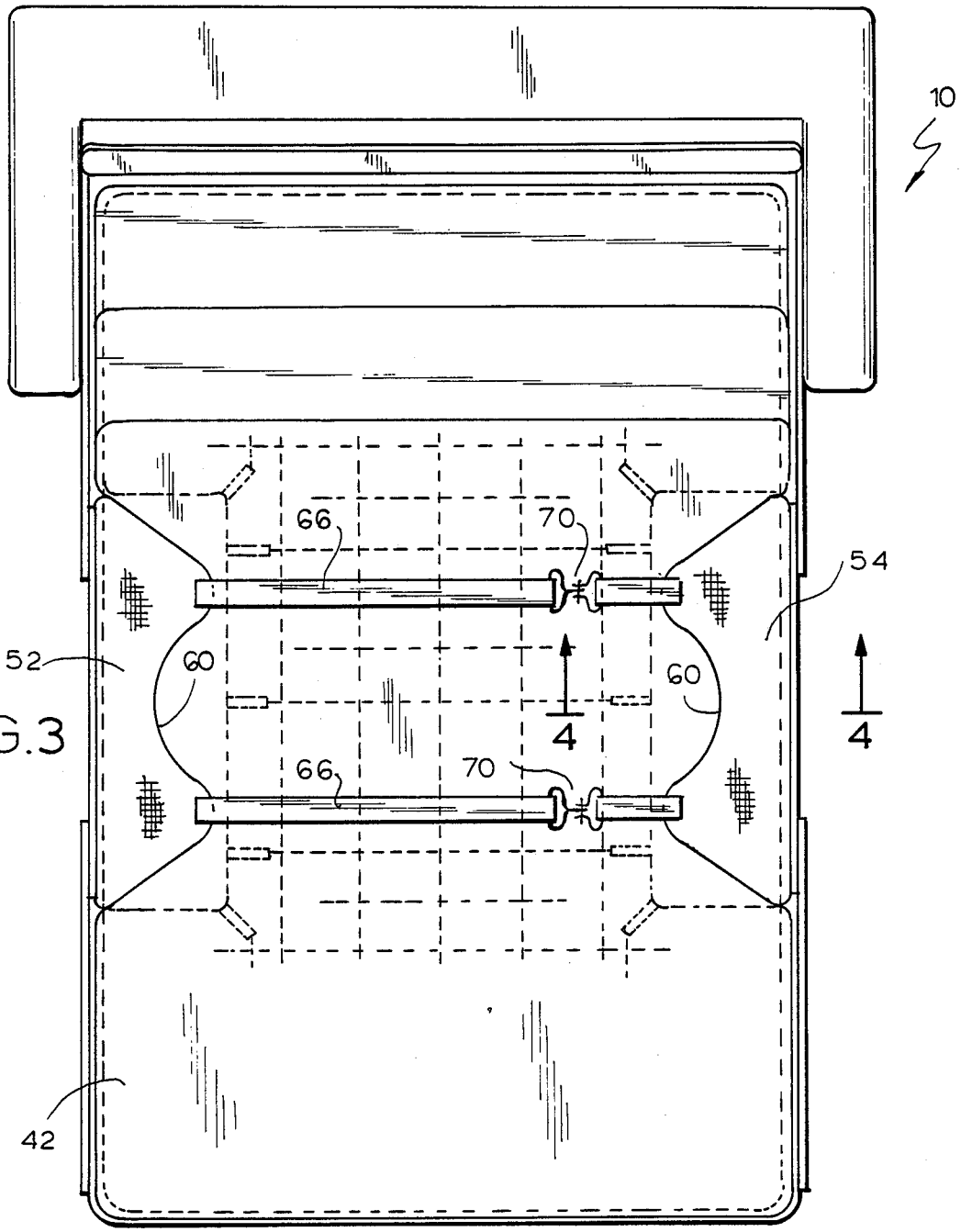
FIG. 3 is a plan view of the sofa bed mechanism illustrated in FIG. 2.
Figure 4:
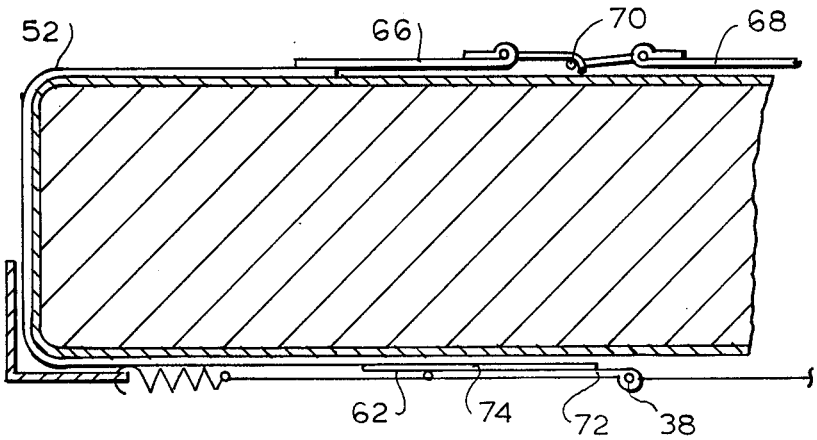
FIG. 4 is a partial sectional view taken along line 4—4 of FIG. 3.

Referring now to the drawing in detail and initially to FIG. 1 thereof, a conventional convertible sofa bed 10 is illustrated. The sofa bed includes a frame 12 having a back 14, arms 16, and a front edge 18. Removable seat cushions 20 are mounted in the frame and supported on a conventional folding mechanism 22 which is hidden from view (but shown schematically in dotted lines in FIG. 1) when the mechanism is folded and the cushions are in place. Sofa 10 also includes back cushions 24 which may or may be removable.

Referring to FIG. 2, sofa bed 10 is illustrated in its unfolded position, with cushions 20 and 24 removed. As mentioned the mechanism 22 is of known construction and consists of a plurality of pivotally interconnected sections 26, 28, 30. A linkage mechanism 32 operatively connects the various pivotally connected sections to permit the mechanism to be folded into the base of the sofa in a known manner, behind front edge 18. Such convertible sofa bed mechanisms are currently available and have been for many years from the Castro Convertible Corporation of New Hyde Park, N.Y. Therefore, the specific details of the mechanism, which form no part of the present invention, need not be described here in detail.

Folding mechanism 22 includes a wire mesh spring mattress support grid 34, also of known construction. This grid support consists generally of a plurality of metal wires 36 in a grid pattern secured to a peripheral wire 38 which, in turn, is secured to frame elements 26, 28, 30 by spring connections 40. The mattress support 34 provides a firm support for a mattress 42 which rests thereon. When the mechanism is folded to convert the sofa bed 10 into a sofa, the mattress folds with the mechanism and is contained therein.

Often, the home owner prefers to leave the bedding for the sofa bed on mattress 42 when the sofa is folded, so that it is available for use again the next evening. The bedding typically will consist of an undersheet for the mattress, an oversheet and possibly a blanket or quilt. One problem that has been found with leaving the bedding on the mattress when the mechanism is folded is that the bedding at the folds, particularly at the most complex U fold 44 formed in the mattress adjacent the center frame section 28, will spread out away from the mattress and become entangled within the complex linkage mechanism 32 located at that precise point. As mentioned, this will potentially damage the bedding, or jam the mechanism.

In accordance with the present invention a mattress guard 50 is provided which holds the bedding against the mattress to prevent it from becoming entangled within mechanism 32. This mattress guard consists of a pair of flexible sheet like members 52, 54 located along opposite longitudinal edges 56, 58 of mattress 42 and positioned adjacent section 28 near folding linkage 32. These members 52, 54 are formed of a cloth material, preferrably canvas or the like, and have first edges 60 facing each other on the top surface of the mattress and lower edges 62 facing each other on the bottom surface of the mattress, with the center portions 64 of the sheets being located over the sides of the mattress.

The first or upper edges 60 of the mattress guard sheets 52, 54 are connected by resilient straps 66, 68, which are releasably interconnected in any convenient manner, such as for example by a conventional hook and eye arrangment 70. These straps are formed of an elastic fabric material, of known construction, sewn to the edges 60 in the positions illustrated in FIG. 2. These elastic straps tend to pull the edges 60 towards each other when connected by the hooks and eyes 70.

The lower or second edges 62 of the mattress guard sheets have metal hooks 72 secured thereto in any convenient manner. For example these hooks can be sewn onto elastic straps 74 which in turn are sewn onto the edges 62 of the guards. These hooks are adapted to engage one or more of the wires 36 of the mattress support grid 34 in order to resist outward movement of the edges 62 with respect to the grid. As a result of this construction, when elastic straps 66, 68 are interconnected by the hook and eye arrangements 70, they produce an inward tension drawing the edges 60 together and pulling the mattress guards or sheets tightly against the side edges of the mattress and the bedding thereon. When the sofa bed is folded, this arrangement prevents the bedding on the mattress from falling outwardly into the linkage mechanism and insures that the bedding does not become entangled within the linkage mechanism.

In a preferred embodiment of the invention the mattress guard is used with an inflatable air mattress. With such an arrangment it is typical that the air mattress be inflated when the sofa bed is extended into the position shown in FIG. 2, and be partially deflated when the sofa bed is folded. This permits a more compact construction for the sofa bed mechanism so that the sofa's overall dimensions, and particularly its seating height, will more closely conform to seating height of conventional nonconvertible sofas. With inflatable mattresses however, when the mattresses deflate, the mattress loses some of its form, and its outer skin becomes slack. Thus, when it is folded the edges of the mattress itself may move outwardly and become entangled in mechanism 32. By using the mattress guard of the present invention on such mattresses the elastic straps tend to pull the sides of the mattress inwardly, as illustrated in FIG. 5, thereby insuring that the edges of the mattress itself do not become entangled in the folding bed mechanism. Thus, potential damage to the mattress is avoided.

When the sofa bed mechanism is moved to its unfolded position, illustrated in FIG. 2, the hooks 70 are disconnected, and the mattress guard is permitted to drape over the mechanism 32 as illustrated by dotted lines in FIG. 2, thereby exposing the mattress for use, while also serving to shield the linkage mechanism 32 from clothing or the like which may also become inadvertently tangled therein.

Accordingly, it is seen that a relatively simply contructed mattress guard is provided for protecting a mattress, and its bedding, from the linkage mechanism of a conventional sofa bed.

Although an illustrative embodiment of the present invention has been described herein with reference to the accompanying drawings, it is to be understood that various changes and modifications maybe effective therein by those skilled in the art without departing from the scope or spirit of this invention.

What is claimed is:

1. A mattress guard for use in a convertible sofa bed mattress having a flat and a folded condition which is supported on a foldable frame to which a mattress support is secured and which is adapted to have bedding thereon, said mattress having an upper side and a lower side, said mattress guard comprising a pair of flexible mattress edge guard sheet members which adapted to be connected together when said bed is unfolded and to hold said bedding for the mattress securely against the mattress and prevent it from becoming entrapped in said folding mechanism when said bed is folded, each of said guard sheet members having first and second opposed edges, elastic means for resiliently interconnecting said first edges of said guard sheets on said upper side of the mattress in both said flat and folded conditions, said elastic means comprising two spaced apart pairs of opposed stretchable elastic straps with the first strap of each pair connected to the first edge of one guard sheet and the second strap of each pair connected to the first edge of the other guard sheet and releasable means respectively associated with each pair of straps for releasably connecting said first strap to said second strap of each of said pairs across the upper side of said mattress, said first opposed edges of said guard sheet members having a centrally disposed concave region between said elastic straps and means on said second edges for securing said second edges to said mattress support below the mattress.

2. A mattress guard as defined in claim 1 wherein said sheet members are formed of fabric.

3. A mattress guard as defined in claim 1 wherein said means on said second edges for securing said second edges to said mattress support comprise second releasable means for releasably securing said second edges to said mattress support.

4. A mattress guard as defined in claim 3 wherein said second releasable means comprise hooks.

5. A mattress guard for use in a convertible sofa bed having an air inflatable mattress supported on a mattress support secured to a folding bed mechanism, said mattress having a top surface and a bottom surface, a flat and a folded condition and begin adapted to have bedding thereon, said guard comprising a pair of flexible guard sheet members adapted to be placed on opposed edges of the mattress and further being adapted to be connected together when said bed is unfolded and to hold said bedding for the mattress securely against the mattress and prevent it from becoming entrapped in said folding mechanism when said bed is folded, elastic means resiliently securing said guard sheet members together along the top surface of the mattress in both said flat and folded conditions, said elastic means comprising two spaced apart pairs of stretchable elastic straps with the first strap of each pair connected to the first edge of one guard sheet and the second strap of each pair connected to the first edge of the other guard sheet and releasable means respectively associated with each pair of straps for releasably connecting the first strap of each of said pairs to the second strap of each of said pairs across the top surface of said mattress, said first opposed edges of said guard sheet members having a centrally disposed concave region between said elastic straps and means for securing the guard sheet members to the mattress support below the mattress.

6. A mattress guard comprising a pair of flexible guard sheet members adapted to be placed on opposed edge of a mattress having a flat and a folded condition and adapted to have bedding placed thereon, said guard sheets being adapted to be connected together when said bed is unfolded and to hold said bedding for the mattress securely against the mattress and prevent it from becoming entrapped in said folding mechanism when said bed is folded, elastic means resiliently securing said guard sheet members together along the top surface of the mattress in both said flat and folded conditions, said elastic means comprising two spaced apart pairs of stretchable elastic straps with the first strap of each pair of connected to the first edge of one guard sheet and the second strap of each pair connected to the first edge of the other guard sheet and releasable means respectively associated with each pair of straps for releasably connecting the first strap to said second strap of each of said pairs across the top surface of said mattress, said first opposed edges of said guard sheet members having a centrally disposed concave region between said elastic straps, and means for securing the guard sheet members to a relatively rigid structure below the mattress.

* * * * *